United States Patent [19]

Everett et al.

[11] Patent Number: 4,742,306

[45] Date of Patent: May 3, 1988

[54] ENGINE ANALYSERS

[75] Inventors: Geoffrey J. Everett, Bucklebury; Christopher J. Hunt, Somerset, both of England

[73] Assignee: FKI Crypton Limited, Sumerset, England

[21] Appl. No.: 837,350

[22] Filed: Mar. 7, 1986

[30] Foreign Application Priority Data

Mar. 7, 1985 [GB] United Kingdom ..... 8505875

[51] Int. Cl.[4] ..... F02P 17/00

[52] U.S. Cl. ..... 324/379; 324/393; 324/388; 324/402

[58] Field of Search ..... 324/388, 391, 392, 379, 324/378, 393, 402

[56] References Cited

U.S. PATENT DOCUMENTS 4,379,263 4/1983 Everett et al. ..... 324/379

*Primary Examiner*—Reinhard J. Eisenzopf
*Assistant Examiner*—Anthony L. Miele
*Attorney, Agent, or Firm*—Solon B. Kemon

[57] ABSTRACT

An apparatus for generating a synchronizing signal for a selected cylinder of a multi-cylinder engine having a double ended coil ignition system, including a comparator for identifying a real ignition pulse on the ignition device associated with the selected cylinder and a discriminator for identifying a real ignition signal on the coil energizing that ignition device and circuitry to produce a synchronizing signal only when the two coincide.

10 Claims, 2 Drawing Sheets

20
21
20
21
20
21
20
21

ENGINE ANALYSERS

The present invention relates to engine analysers and in particular to an engine analyser for an ignition system having one or more double ended ignition coils.

BACKGROUND OF THE INVENTION

With conventional distributor ignition systems each cylinder receives an ignition signal only on the firing compression stroke of that cylinder.

With a double ended coil ignition system, in which spark plugs are connected to both ends of the secondary winding of the ignition coil, the one coil is supplying the ignition signal for two cylinders. As the firing or compression stroke of one of the cylinders will coincide with the exhaust stroke of the other cylinder and the coil produces ignition signals simultaneously at both cylinders, one cylinder will receive a "real" ignition signal when that cylinder is on its firing stroke while the other cylinder receives a "wasted" ignition signal on its exhaust stroke.

For the synchronisation of an engine analyser, it is necessary to generate a synchronising signal identifying the beginning of the true ignition sequence of a known cylinder, usually the first cylinder in the firing order.

SUMMARY OF THE INVENTION

According to one aspect of the present invention an apparatus for generating a synchronising signal from a selected cylinder of a multi cylinder engine having a double ended coil ignition system comprises; means for identifying a real ignition pulse at said cylinder, means for identifying an ignition signal on the primary winding of the coil corresponding to that cylinder and means for producing a synchronising signal only when the real ignition pulse coincides with the ignition signal on the primary of the coil.

When carrying out certain tests, for example, cylinder power balancing, it is necessary to inhibit the firing of the selected cylinder. During this process it is also desirable to inhibit the synchronising signal which may otherwise confuse the engine analyser. The apparatus according to the present invention will preferably also inhibit generation of a synchronising signal when firing of the selected cylinder is inhibited.

BRIEF DESCRIPTION OF THE DRAWINGS

An embodiment of the invention is now described, by way of example only, with reference to the accompanying drawings in which.

DESCRIPTION OF A PREFERRED EMBODIMENT

Figure 1:
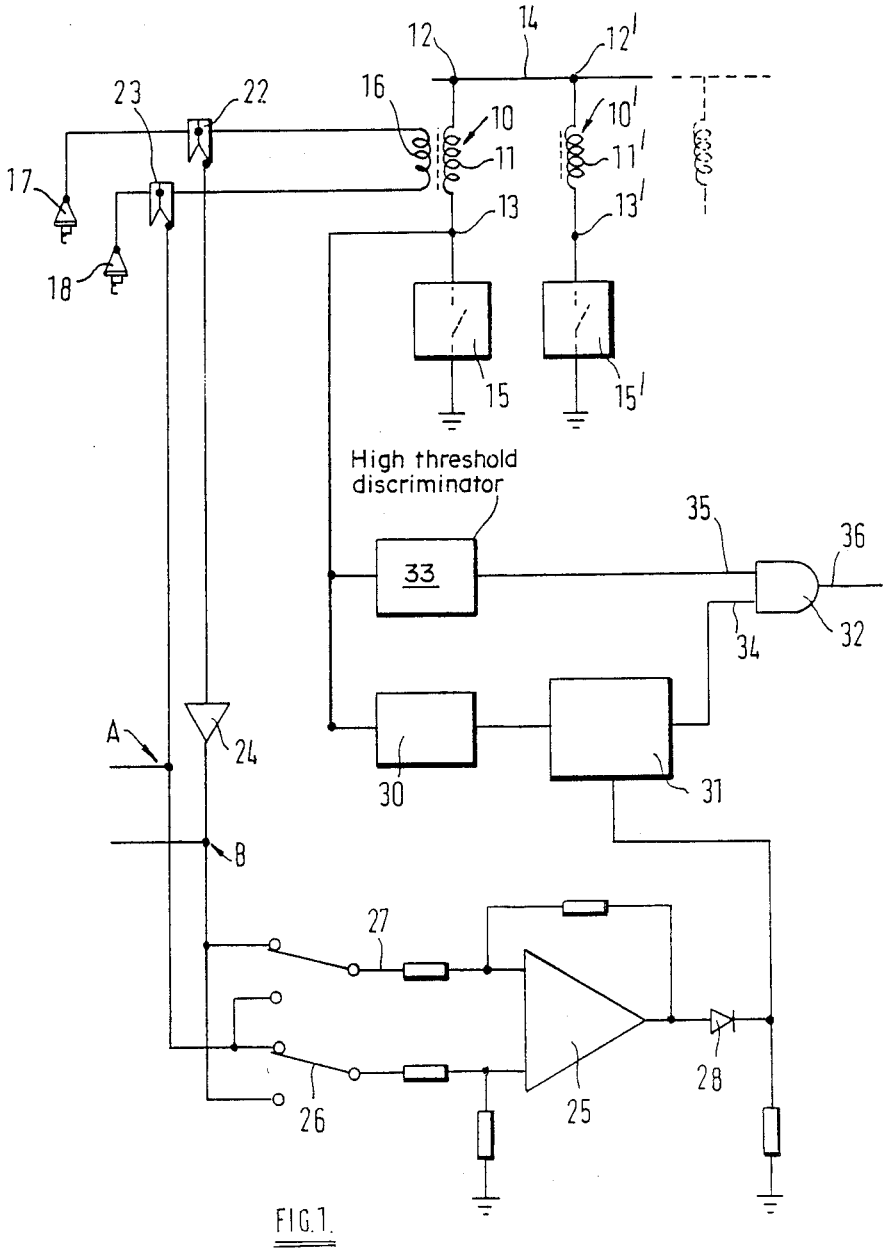
FIG. 1 is a diagrammatic illustration of a double-ended coil ignition system, with means for generating a synchronising signal in accordance, with the present invention.

FIG. 1 shows a multi-coil ignition system comprising a plurality of ignition coils 10, 10' etc, one coil being provided for every two cylinders of the engine, i.e. 2 coils for a 4 cylinder engine, 3 coils for a 6 cylinder engine and so on. The primary winding 11, 11' of each coil is connected via a first terminal 12, 12' to a voltage supply line 14 and via a second terminal 13, 13' to earth through switch means 15, 15'. The switch means 15, 15' may be electronic or mechanical switches driven by engine rotation and serve to complete the circuit through the primary winding 11, 11' of coil 10, 10'. The secondary winding 16 (only one shown) of each coil 10, 10' is connected to two spark plugs 17, 18.

When the switch means 15, 15' is closed the primary winding 11, 11' of coil 10, 10' is energised. The current induced in the secondary winding 16 when the supply voltage (say 12 volts) passes through the primary winding 11, 11' is not sufficient to fire the spark plugs. 17, 18. However, when the switch means 15, 15' is opened a back EMF pulse of several hundred volts is induced in the primary winding 11, 11'. This pulse constitutes an ignition signal which identifies the beginning of an ignition sequence on one of the cylinders associated with spark plugs 17, 18. The ignition signal induces an ignition pulse in the secondary winding 16 which is sufficient to fire both spark plugs 17, 18. The ignition pulse at spark plugs 17, 18 are coincident but of opposite polarity.

Figures 2A, 2B:
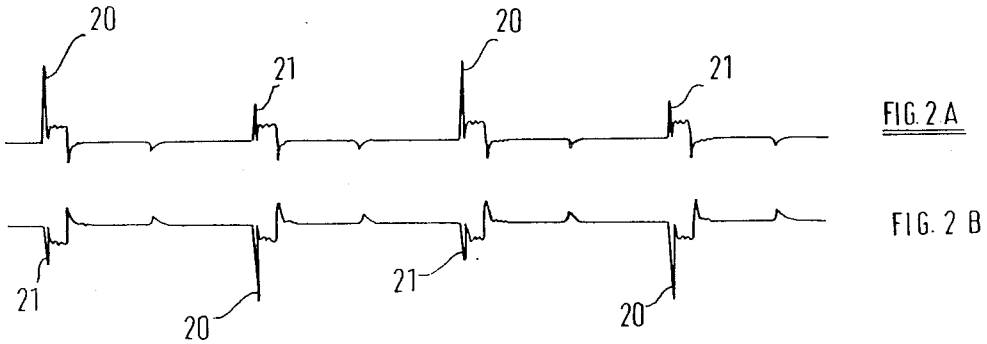
FIGS. 2A and 2B illustrate the signals at a pair of spark plugs connected to a double ended ignition coil.

The spark plugs 17, 18 are disposed in cylinders which are 360° out of phase, for example cylinders 1 and 4 or 2 and 3 of a four cylinder engine. One of the spark plugs 17 is arranged to fire at the appropriate point in the ignition stroke of the cylinder with which it is associated, while the coincident ignition pulse on spark plug 18 will cause that plug 18 to fire on the exhaust stroke of its associated cylinder, and vice versa. The ignition pulses that occur on the ignition strokes are termed "real" pulses 20, while those occuring on exhaust strokes are "wasted" pulses 21. Because of the difference in conditions in the cylinders on the ignition and exhaust strokes, under normal operating conditions the "real" pulses 20 will be of greater amplitude than the "wasted" pulses 21. FIGS. 2A and 2B show typical ignition pulse signals at a pair of spark plugs 17, 18.

A pair of capacitive pick-up probes 22, 23 are connected, one to each of the spark plugs 17, 18 so that they will generate signals corresponding to the ignition pulse applied to the spark plugs 17, 18. An inverter 24 is provided in the line from probe 22, so that the signals corresponding to coincident real and waste pulses at plugs 17, 18 will be of the same polarity at points A and B. An engine analyser is connected to points A and B and probes 22, 23 are connected to spark plugs 17, 18 so as to provide negative going ignition signals at points A and B.

The signal from points A and B are connected to a differential amplifier 25 via a changeover switch 26. The switch 26 is positioned such that the probe connected to spark plug 17 which is associated with the selected cylinder, is connected to terminal 27 of the differential amplifier 25. The differential amplifier 25 compares the coincident signals from probes 22 and 23 and generates a phasing signal through diode 28, only when a "real" ignition pulse occurs at the selected cylinder.

Terminal 13 of coil 10 is connected via a low threshold discriminator 30 and bistable 31 to one input 34 of an AND-gate 32, and via a parallel high threshold discriminator 33 to the other input 35 of the AND-gate 32. The output from the low threshold discriminator 30 clocks the bistable 31 so that the bistable 31 will generate an output signal which is applied to the input 34 of AND-gate 32, on every second signal passed by the low threshold discriminator 30. The output from diode 28 is fed to the bistable 31 to phase the bistable 31 so that the output signal from the bistable 31 will coincide with the "real" ignition pulse at the selected cylinder. The high threshold discriminator 33 produces an output signal for every ignition signal on the primary winding 11 of coil 10, which results in the firing of spark plugs 17, 18 and this output signal is applied to input 35 of AND-gate 32. When the output signals form bistable 31 and high threshold discriminator 33 coincide, a synchronising signal is generated at the output 36 of the AND-gate 32. This synchronising signal may be used to synchronise an engine analyser clock with the sequence of firing of the cylinders, in known manner.

During normal firing, the signal at terminal 13 will vary from about the supply voltage (eg. 12 volts) to several hundred volts when the ignition sequence of the cylinders associated with spark plugs 17, 18 begins. The low threshold discriminator 30 will generate an output signal only when the voltage at terminal 13 rises above the supply voltage and will consequently produce an output signal corresponding to every ignition signal on the primary winding 11. The threshold voltage of the high threshold discriminator 33 is also below the voltage of the ignition signal on primary winding 11 when firing occurs and consequently an output signal will be generated by the high threshold discriminator 33 corresponding to every ignition signal on the primary winding 11. The synchronising signal occuring at the output 36 of AND-gate 32 will consequently coincide with the "true" ignition pulse at the selected cylinder.

During power balancing tests on the selected cylinder, when the ignition for that cylinder is disabled, the ignition signal on the primary winding 11 falls to about 20 volts. This reduced voltage ignition pulse is still above the threshold voltage of the low threshold discriminator 30, so that an output signal continues to be generated to clock the bistable 31. However, the reduced voltage of the ignition signal on the primary winding 11, is below the threshold voltage of the high threshold discriminator 33. Consequently, although the output signal from bistable 31 continues to be generated in synchronisation with the true ignition pulse at the selected cylinder, no output signal is generated by the high threshold discriminator 33 and no synchronising signal will be generated at the output 36 of AND-gate 32.

We claim:

1. An apparatus for generating a synchronising signal for a selected cylinder of a multi-cylinder engine having a double ended coil ignition system, said apparatus comprising means for identifying a real ignition pulse at said cylinder, means for identifying an ignition signal on the primary winding of the coil corresponding to that cylinder and means for producing a synchronising signal only when the real ignition pulse coincides with the ignition signal on the primary of the coil.

2. An apparatus according to claim 1 in which the means for identifying a real ignition pulse comprises a comparator for comparing the magnitude of the ignition pulses applied simultaneously to two ignition devices connected to opposite ends of the secondary winding of one of the coils of the ignition system, said comparator producing a signal only when the magnitude of the ignition pulse on a selected one of the two ignition devices exceeds the magnitude of the pulse on the other ignition device.

3. An apparatus according to claim 2 in which a first ignition device which is associated with the selected cylinder and a second ignition device which is connected to the same coil as the first ignition device are separately connected via a pair of capacitive pick-ups to the comparator.

4. An apparatus according to claim 3 in which an inverter is included in one of the leads between the capacitive pick-ups and the comparator.

5. An apparatus according to claim 2 in which the comparator includes a differential amplifier.

6. An apparatus according to claim 2 in which the signal produced by the comparator is used to apply a signal to a first input of an AND-gate for every real ignition pulse applied to the ignition device associated with the selected cylinder.

7. An apparatus according to claim 1 in which a means for identifying an ignition signal on the primary winding of the coil corresponding to the selected cylinder, includes a discriminator, the threshold voltage of said discriminator being set at a minimum ignition signal required on the primary winding to produce an ignition pulse on the secondary winding.

8. An apparatus according to claim 7 in which the means for identifying a real ignition pulse comprises a comparator for comparing the magnitude of the ignition pulses applied simultaneously to two ignition devices connected to opposite ends of the secondary winding of one of the coils of the ignition system, said comparator producing a signal only when the magnitude of the ignition pulse on a selected one of the two ignition devices exceeds the magnitude of the pulse on the other ignition device, the signal produced by the comparator being used to apply a signal to a first input of an AND-gate for every real ignition pulse applied to the ignition device associated with the selected cylinder; said discriminator applying a signal to a second input of the AND-gate for every ignition pulse on the secondary winding.

9. An apparatus according to claim 8 in which a second discriminator is connected in parallel with the first discriminator, said second discriminator having a threshold voltage below the minimum voltage that will be applied to the primary winding of the coil associated with the selected cylinder, so that the second discriminator will provide a signal for each pulse applied to the primary coil, whether inhibited or not; the signal from the second discriminator being used to clock a bistable device, said bistable device applying a signal to the first input of the AND-gate on every second pulse produced by the second discriminator; the signal produced by the comparator being used to phase the output from the bistable device with the occurrence of a real ignition pulse.

10. An engine analyser including an apparatus for generating a synchronising signal for a selected cylinder of a multi-cylinder engine having a double ended coil ignition system, said apparatus comprising means for identifying a real ignition pulse at said cylinder, means for identifying an ignition signal on the primary winding of the coil corresponding to that cylinder and means for producing a synchronising signal only when the real ignition pulse coincides with the ignition signal on the primary of the coil.

* * * * *